US007812791B2

(12) United States Patent
Jeon

(10) Patent No.: US 7,812,791 B2
(45) Date of Patent: Oct. 12, 2010

(54) ELECTRON EMISSION DISPLAY AND DRIVING METHOD THEREOF

(75) Inventor: Dong Hyup Jeon, Cheonan-si (KR)

(73) Assignee: Samsung SDI Co., Ltd., Giheung-gu, Yongin-si, Gyeonggi-do (KR)

( * ) Notice: Subject to any disclaimer, the term of this patent is extended or adjusted under 35 U.S.C. 154(b) by 1180 days.

(21) Appl. No.: 11/407,091

(22) Filed: Apr. 20, 2006

(65) Prior Publication Data

US 2006/0267880 A1 Nov. 30, 2006

(30) Foreign Application Priority Data

May 31, 2005 (KR) ..... 10-2005-0046443

(51) Int. Cl.
*G09G 3/22* (2006.01)

(52) U.S. Cl. ..... 345/75.2; 345/74.1; 345/75.1; 345/77; 345/602; 313/495; 313/496; 348/796

(58) Field of Classification Search ..... 345/74.1, 345/75.1, 75.2, 77; 313/495–496; 348/796
See application file for complete search history.

(56) References Cited

U.S. PATENT DOCUMENTS 5,278,544 A * 1/1994 Leroux ..... 345/74.1
2003/0085905 A1* 5/2003 Mori et al. ..... 345/589
2003/0210256 A1* 11/2003 Mori et al. ..... 345/690
2005/0127813 A1* 6/2005 Moon ..... 313/495

FOREIGN PATENT DOCUMENTS

KR 10-2005-0032321 4/2005
WO WO 02/33689 A1 4/2002

* cited by examiner

*Primary Examiner*—Richard Hjerpe
*Assistant Examiner*—Saifeldin Elnafia
(74) *Attorney, Agent, or Firm*—Robert E. Bushnell, Esq.

(57) ABSTRACT

An electron emission display and a driving method thereof adjust a brightness differently according to a brightness of a frame in order to reduce power consumption and prevent a gradual failure from occurring, and easily recognize a change of the brightness. A pixel portion receives a data signal and a scan signal, and displays an image. A data driver generates the data signal using video data and transfers the data signal to the pixel portion. A scan driver transfers the scan signal to the pixel portion. A timing controller transfers a drive signal to drive the data driver and the scan driver, to the data driver and the scan driver. A data processor generates a control signal corresponding to frame data obtained by summing a value of video data inputted during one frame. A power supply section generates a drive voltage and transfers the drive voltage to the pixel portion, the data driver, the scan driver, the timing controller, and the data processor. A brightness of the pixel portion is changed according to the control signal, and a change amount of the brightness is changed according to a hysteresis curve.

11 Claims, 6 Drawing Sheets

ELECTRON EMISSION DISPLAY AND DRIVING METHOD THEREOF

CLAIM OF PRIORITY

This application makes reference to, incorporates the same herein, and claims all benefits accruing under 35 U.S.C. §119 from an application for ELECTRON EMISSION DISPLAY AND DRIVING METHOD THEREOF earlier filed in the Korean Intellectual Property Office on the 31 May 2005 and there, duly assigned Serial No. 10-2005-0046443.

BACKGROUND OF THE INVENTION

1. Field of the Invention

The present invention relates to an electron emission display and a driving method thereof, and more particularly, which adjust a brightness differently according to a brightness of a frame in order to reduce power consumption and prevent a gradual failure from occurring.

2. Discussion of the Related Art

Lightweight and thin flat panel displays have been used as either a display of a portable information terminal such as a personal computer, a portable telephone, and a Personal Digital Assistance (PDA) or a monitor of all kinds of information devices. A Liquid Crystal Display (LCD) using a liquid crystal panel, an organic light emitting display using Organic Light Emitting Diodes (OLEDs), and a Plasma Display Panel (PDP) using a plasma panel are examples of such a flat panel display.

Flat panel displays are classified as active matrix displays and passive matrix displays according to their construction, and memory drive displays and non-memory drive displays according to their drive method. In general, the active matrix displays can correspond to the memory drive displays, and the passive matrix displays can correspond to the non-memory drive displays. The active matrix displays and memory drive displays emit light in frames. In contrast to this, the passive matrix and non-memory drive displays emit light in lines.

In commonly used flat panel displays, Thin Film Transistor Liquid Crystal Displays (TFT-LCDs) are active matrix displays, and a newly developed Organic Light Emitting Diodes (OLEDs) are also active matrix displays. In contrast to this, an electron emission display is a passive matrix display. Unlike flat panel displays, the electron emission display is a non-memory drive display and uses a line scan that emits light only when a selected line among horizontal lines is selected while sequentially selecting the horizontal lines. That is, the electron emission display drives have a constant duty ratio.

An electron emission display includes a pixel portion, a data driver, a scan driver, a timing controller, and a power supply section.

The pixel portion includes pixels formed at intersecting parts of cathode electrodes and gate electrodes. In the pixels, electrons emitted by the cathode electrodes collide with the anode electrodes to emit light of fluorescent substances, thereby representing a gray scale of an image. The represented gray scale of an image changes according to a value of an input digital image signal. In general, in order to adjust the gray scale expressed according to the value of a digital image signal, a Pulse Width Modulation (PWM) mode or a Pulse Amplitude Modulation (PAM) mode can be used.

The data driver is coupled to the cathode electrodes, and generates and transfers a data signal to the pixel portion, so that the pixel portion emits light corresponding to the data signal.

The scan driver is coupled to the gate electrodes, and generates and transfers a scan signal to the pixel portion. The pixel portion sequentially emits light during a predetermined time period in horizontal line units and in a line scan manner. This causes a total screen to be displayed, thus reducing a cost of the circuits and its power consumption.

The timing controller transfers a data driver control signal and a scan driver control signal to the data driver and the scan driver in order to respectively control operations of the data driver and the scan driver.

The power supply section supplies power to the pixel portion, the data driver, the scan driver, and the timing controller, so that the pixel portion, the data driver, the scan driver, and the timing controller operate.

The electron emission display having the construction mentioned above, expresses a gray scale according to brightness data regardless of total frame data. Consequently, in order to express a higher brightness, a large amount of current flows through the pixel portion. In order to express a lower brightness, a small amount of current flows through the pixel portion. When a large amount of current flows through the pixel portion to express a higher brightness, a large load is applied to the power supply section. This causes a problem in that a high output power supply section is required.

Furthermore, a person's eyes sense brightness changes of a dark image better than that of a bright image. Consequently, the brightness change amount of the dark image must be increased.

SUMMARY OF THE INVENTION

Accordingly, it is an aspect of the present invention to provide an electron emission display and a driving method thereof, which adjust a brightness differently according to a brightness of a frame in order to reduce power consumption and prevent a gradual failure from occurring, and which easily recognizes a change of the brightness.

The foregoing and/or other aspects of the present invention are achieved by providing an electron emission display including: a pixel portion adapted to receive a data signal and a scan signal, and to display an image; a data driver adapted to generate the data signal using video data and to transfer the data signal to the pixel portion; a scan driver adapted to transfer the scan signal to the pixel portion; a timing controller adapted to transfer a drive signal to the data driver and the scan driver, the drive signal adapted to drive the data driver and the scan driver; a data processor adapted to generate a control signal corresponding to frame data obtained by summing a value of video data inputted during one frame; and a power supply section adapted to generate a drive voltage and to transfer the drive voltage to the pixel portion, the data driver, the scan driver, the timing controller, and the data processor. A brightness of the pixel portion is changed according to the control signal and a change amount of the brightness is changed according to a hysteresis curve.

The hysteresis curve is preferably adapted to maintain a constant brightness when the frame data does not exceed a predetermined value, and to change a brightness when the frame data exceeds the predetermined value.

The data processor preferably includes: a data summer adapted to sum the value of video data inputted during one frame to generate the frame data; a first look-up table selected when the brightness is increased and adapted to store an output voltage of the power supply section corresponding to the frame data; a second look-up table selected when the brightness is reduced and adapted to store an output voltage of the power supply section corresponding to the frame data; and a signal processor adapted to detect a value change of the frame data, to select one of the first and second look-up tables according to the value change of the frame data, to generate the control signal corresponding to the output voltage of the power supply section stored in the first or second look-up table, and to control the drive voltage from the power supply section with the control signal.

The first and second look-up tables are preferably adapted to store an output voltage of the power supply section corresponding to different frame data according to a voltage level.

The change amount of the brightness is preferably respectively small and large when the value of the frame data is large and small.

The power supply section is preferably adapted to adjust at least one drive voltage of the pixel portion, the scan driver, and the data driver to adjust one of a voltage supplied to the pixel portion, an output voltage of the scan driver, and an output voltage of the data driver.

The pixel portion preferably includes: a lower substrate; a cathode electrode arranged in a stripe shape on the lower substrate; a first insulation film arranged on the lower substrate and the cathode electrode and including an opening exposing a portion of the cathode electrode; a gate electrode arranged on the first insulation film across the cathode electrode, and including a second opening corresponding to the first opening; an electron emission section arranged on the cathode electrode corresponding to the first and second openings; a upper substrate spaced apart from the lower substrate and including a fluorescent film adapted to emit light due to electrons emitted by the electron emission section and an anode electrode to which a high voltage is supplied; and a spacer adapted to provide a gap between the lower and upper substrates.

The power supply section is adapted to preferably adjust at least one voltage level of the cathode electrode, the gate electrode, and the anode electrode.

The foregoing and/or other aspects of the present invention are also achieved by providing a method of driving an electron emission display, the method including: summing a value of video data inputted during one frame to generate frame data; adjusting a voltage level of a drive power supply corresponding to the value of the frame data; and changing brightness according to the voltage level of the drive power supply, the brightness being changed according to a hysteresis curve.

The voltage level of the drive power supply is preferably adjusted in accordance with a first look-up table in response to a difference between a value of frame data of a predetermined frame and a value of frame data of a previous frame being positive, and the voltage level of the drive power supply is preferably adjusted in accordance with a second look-up table in response to a difference between a value of frame data of a predetermined frame and a value of frame data of a previous frame being negative.

The first and second look-up tables are preferably composed using a predetermined bit of the frame data.

The change amount of the brightness is preferably small upon a value of the frame data being large, and the change amount of the brightness is preferably large upon the value of the frame data being small.

The voltage level of the drive power supply preferably adjusts at least one of voltage levels of anode, cathode, and gate electrodes of a pixel portion.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

Figure 1:
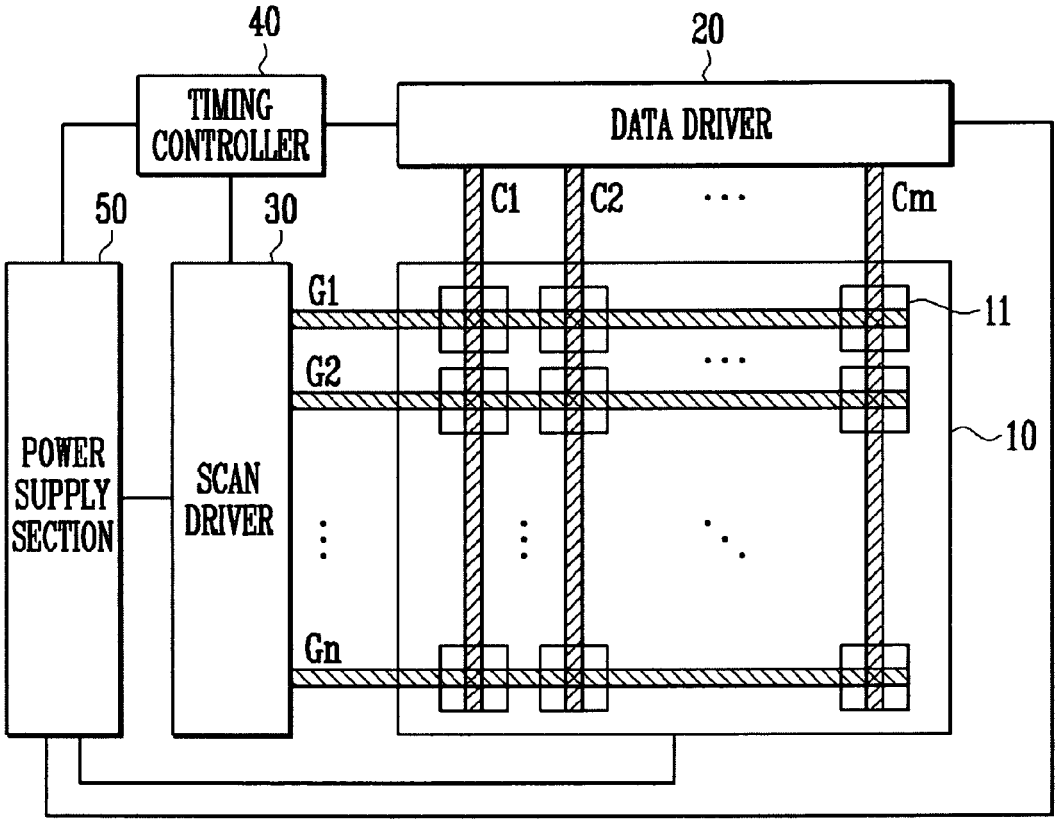
FIG. 1 is view of an electron emission display.

FIG. 1 is view of an electron emission display. With reference to FIG. 1, the electron emission display includes a pixel portion 10, a data driver 20, a scan driver 30, a timing controller 40, and a power supply section 50.

The pixel portion 10 includes pixels 11 formed at intersecting parts of cathode electrodes C1, C2 . . . Cm and gate electrodes G1, G2 . . . Gn. In the pixels 11, electrons emitted by the cathode electrodes collide with the anode electrodes to emit light of fluorescent substances, thereby representing a gray scale of an image. The represented gray scale of an image changes according to a value of an input digital image signal. In general, in order to adjust the gray scale expressed according to the value of a digital image signal, a Pulse Width Modulation (PWM) mode or a Pulse Amplitude Modulation (PAM) mode can be used.

The data driver 20 is coupled to the cathode electrodes C1, C2 . . . Cm, and generates and transfers a data signal to the pixel portion 10, so that the pixel portion 10 emits light corresponding to the data signal.

The scan driver 30 is coupled to the gate electrodes G1, G2 . . . Gn, and generates and transfers a scan signal to the pixel portion 10. The pixel portion 10 sequentially emits light during a predetermined time period in horizontal line units and in a line scan manner. This causes a total screen to be displayed, thus reducing a cost of the circuits and its power consumption.

The timing controller 40 transfers a data driver control signal and a scan driver control signal to the data driver 20 and the scan driver 30 in order to respectively control operations of the data driver 20 and the scan driver 30.

The power supply section 50 supplies power to the pixel portion 10, the data driver 20, the scan driver 30, and the timing controller 40, so that the pixel portion 10, the data driver 20, the scan driver 30, and the timing controller 40 operate.

The electron emission display having the construction mentioned above, expresses a gray scale according to brightness data regardless of total frame data. Consequently, in order to express a higher brightness, a large amount of current flows through the pixel portion 10. In order to express a lower brightness, a small amount of current flows through the pixel portion 10. When a large amount of current flows through the pixel portion 10 to express a higher brightness, a large load is applied to the power supply section 50. This causes a problem in that a high output power supply section is required.

Furthermore, a person's eyes sense brightness changes of a dark image better than that of a bright image. Consequently, the brightness change amount of the dark image must be increased.

Hereinafter, exemplary embodiments of the present invention are described with reference to the accompanying drawings. Throughout the drawings, like reference numerals refer to like elements.

Figure 2:
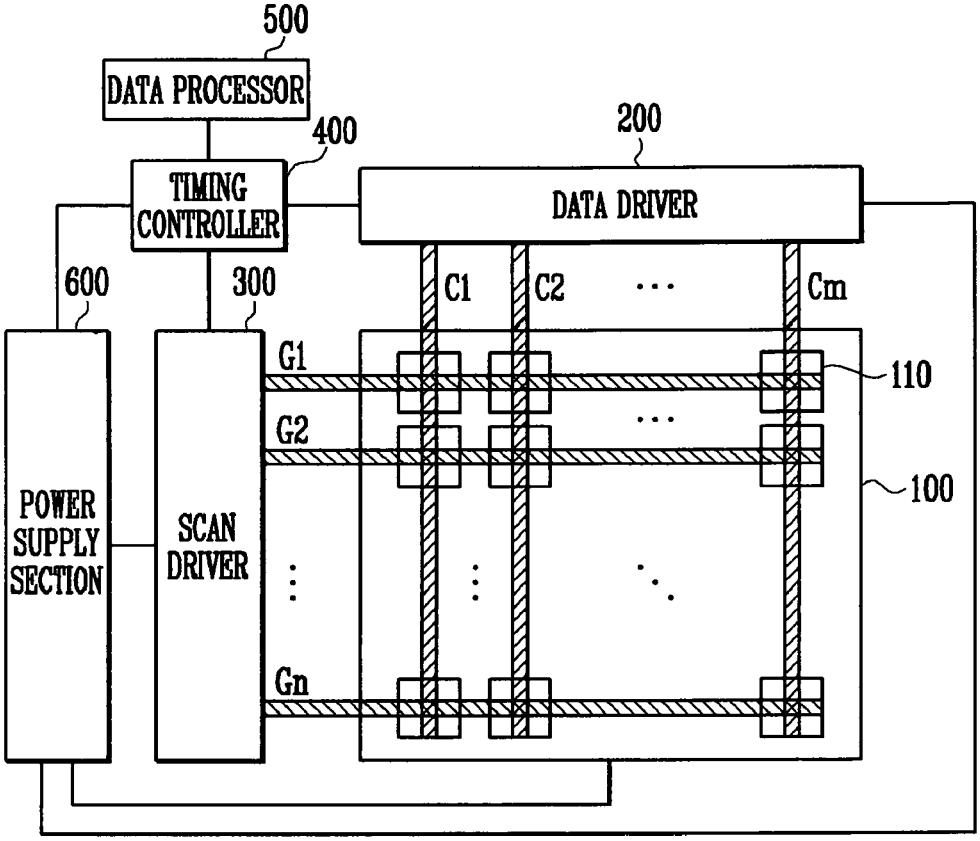
FIG. 2 is a view of an electron emission display according to an embodiment of the present invention.

FIG. 2 is a view of an electron emission display according to an embodiment of the present invention. Referring to FIG. 2, the electron emission display includes a pixel portion 100, a data driver 200, a scan driver 300, a timing controller 400, a data processor 500, and a power supply section.

In the pixel portion 100, a plurality of gate electrodes C1, C2 . . . Cm are arranged in a row direction, and a plurality of gate electrodes G1, G2 . . . Gn are arranged in a column direction. Electron emission sources are provided at every intersection of the cathode electrodes C1, C2 . . . Cm and the gate electrodes G1, G2 . . . Gn to form pixels 110. In contrast to this, gate electrodes C1, C2 . . . Cm can be arranged in the column direction, whereas the gate electrodes G1, G2 . . . Gn can be arranged in the row direction. Hereinafter the pixel portion 100 is explained assuming that the gate electrodes C1, C2 . . . Cm are arranged in a row direction and gate electrodes G1, G2 . . . Gn are arranged in a column direction.

The data driver 200 is coupled to the cathode electrodes C1, C2 . . . Cm, and transfers a data signal to the cathode electrodes C1, C2 . . . Cm. The data driver 200 generates an electrode signal to turn-on/off pixels 110 formed at intersecting points of cathode electrodes C1, C2 . . . Cm and gate electrodes G1, G2 . . . Gn.

The scan driver 300 is connected to the gate electrodes G1, G2 . . . Gn, selects one of the plurality of gate electrodes G1, G2 . . . Gn, and transfers the data signal to the pixels 110 connected to the gate electrodes G1, G2 . . . Gn.

The timing controller 400 receives an image signal and generates a control signal to drive the data driver 200 and the scan driver 300. Furthermore, the timing controller 400 transfers the control signal to the data driver 200 and the scan driver 300. That is, the timing controller 400 generates a first control signal for driving the data driver, and a second control signal for sequentially selecting a horizontal line to drive the scan driver 300.

The data processor 500 limits a brightness corresponding to a brightness expressing one frame using video data inputted during one frame period in order to limit an amount of an electrical current flowing through the pixel portion 100. The limitation of the brightness adjusts and limits a level of an output voltage of the power supply section 600. Furthermore, the data processor 500 adjusts a size of a brightness limit differently a case of a bright frame and a case of a dark frame in order to prevent a rapid change from occurring when there a brightness difference between one frame and a next frame in a plurality of continuously represented frames. That is, when the frame is brightened lower than a predetermined level, the data processor 500 limits the brightness by the same value as that of the previous frame. Similarly, when the frame becomes dark lower than a predetermined level, the data processor 500 limits the brightness by the same value as that of the previous frame.

The power supply section 600 serves to supply power needed by the pixel portion 100, the data driver 200, the scan driver 300, the timing controller 400, and the data processor 500. The power supply section 600 transfers an anode voltage to the pixel portion 100. Furthermore, the power supply section 600 transfers a drive power source to the data driver 200, the scan driver 300, the timing controller 400, and the data processor 500. Furthermore, the power supply section 600 adjusts a voltage level of an output drive power source according to the limitation of brightness so as not to greatly change the amount of electric current flowing through the pixel portion 100. As a result, it is unnecessary for the power supply section 600 to have a high output.

Figure 3:
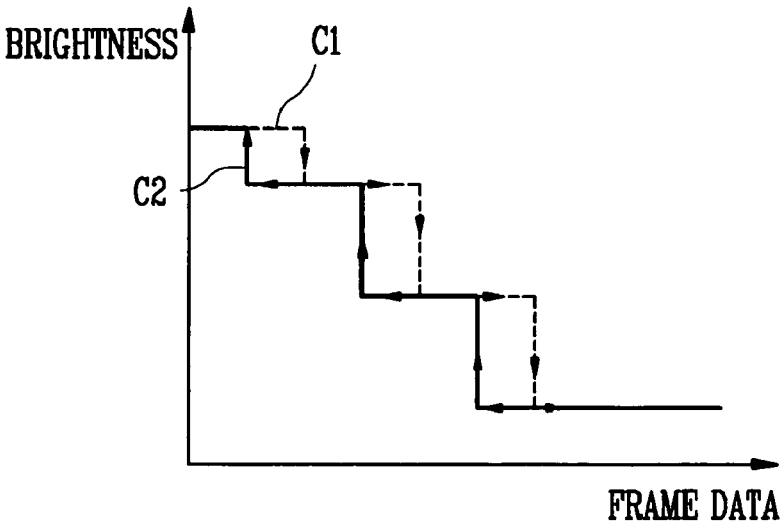
FIG. 3 is a graph of a brightness variation according to a hysteresis curve of the electron emission display of FIG. 2.

FIG. 3 is a graph of brightness variations according to a hysteresis curve of the electron emission display of FIG. 2. Referring to FIG. 3, a transverse axis indicates a size of frame data obtained by summing video data inputted during one frame and a longitudinal axis indicates a brightness of an image. The hysteresis curve is a curve that is unchanged when the frame data does not exceed a threshold value and is changed when the frame data exceeds the threshold value. Consequently, when a brightness is changed according to the hysteresis curve, when the frame data is changed greater than the threshold value, the brightness is changed, but when the frame data is unchanged greater than the threshold value, a previous brightness is maintained.

When the size of the frame data is large, the brightness between gray scales emitting light is adjusted to the highest value to reduce a brightness difference between gray scales.

If the frame data value is high, parts expressing a dark image are included in the image to a great extent. Accordingly, although brightness is limited, a whole screen can be recognized as being bright. In contrast to this, when the frame data value is low, because parts expressing the dark image are included in the image to a lesser extent, the brightness is not limited. Furthermore, when the frame data value is high, when an emission current flowing through the pixel portion is large to significantly change brightness of the image, the power supply section requires a high output. However, when there is a limit to the brightness, the emission current is also limited, so that the power supply section need not have the high output.

The present invention limits the brightness differently when an image expressed by the electron emission display is brightened and when the image becomes dark, thereby preventing a rapid change of the brightness. That is, when the image becomes dark, the electron emission display changes the brightness according to a second graph C2. In contrast to this, when the image is brightened, the electron emission display changes the brightness according to a first graph C1. For example, when the brightness is increased, when a size of frame data is not changed to a value greater than a predetermined value, although the size of the frame data is increased, the frame is controlled to express the same brightness as that of a previous frame, thereby preventing a rapid change of the brightness. Furthermore, when the brightness is decreased, when a size of frame data is not changed to a value lower than a predetermined value, although the size of the frame data is reduced, the frame is controlled to express the same brightness as that of a previous frame, thereby preventing a rapid change of the brightness. As a result, the brightness is unchanged, thereby preventing the occurrence of flicker.

Figure 4:
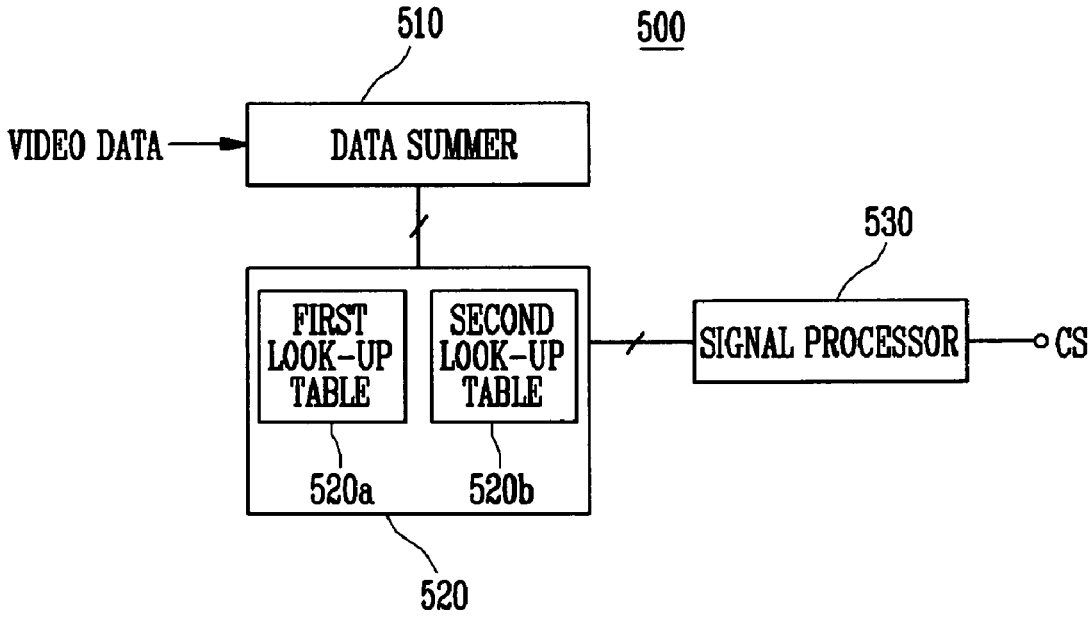
FIG. 4 is a block diagram of an example of a data processor of the electron emission display of FIG. 2.

FIG. 4 is a block diagram of an example of a data processor of the electron emission display of FIG. 2. With reference to FIG. 4, the data processor 500 includes a data summing section 510, a look-up table 520, and a signal processor 530.

The data summer 510 sums video data corresponding to one frame to generate frame data. A high value of frame data means that parts such as a white color representing a high gray scale are significantly included in one frame to be represented. A low value of frame data means that a dark background representing a lower gray scale is significantly included in the one frame to be represented.

The look-up table 520 stores information with respect to a voltage level by values of frame data outputted from the power supply section 600. Accordingly, the look-up table 520 stores information for at least one voltage level among levels of an anode voltage, a cathode voltage, and a gate voltage by frame data. The look-up table 520 is divided into first and second look-up tables 520*a* and 520*b*. The first look-up table 520*a* and the second look-up table 520*b* have bright limit ranges different from each other. In the first look-up table 520*a* and the second look-up table 520*b*, frame data of different values corresponding to the same brightness are set. The first look-up table 520*a* utilizes higher value frame data at the same brightness as compared with the second look-up table 520*b* when the brightness of an image to be represented is increased. The second look-up table 520*b* utilizes higher value frame data at the same brightness as compared with the first look-up table 520*a* when the brightness of an image to be represented is reduced.

Furthermore, the look-up table 520 is composed using upper bits of the frame data, and the size of the look-up table 520 can be small.

A change of the brightness is formed according to the voltage level stored in the look-up table 520 as shown in FIG. 3.

The signal processor 530 detects the frame data generated by the data summer 510, selects the first look-up table 520*a* or the second look-up table 520*b* according to a value change of the frame data. Next, the signal processor 530 searches for a voltage level corresponding to frame data from the first look-up table 520*a* or the second look-up table 520*b*, and transfers a control signal corresponding to the voltage level to the power supply section 600.

Figure 5:
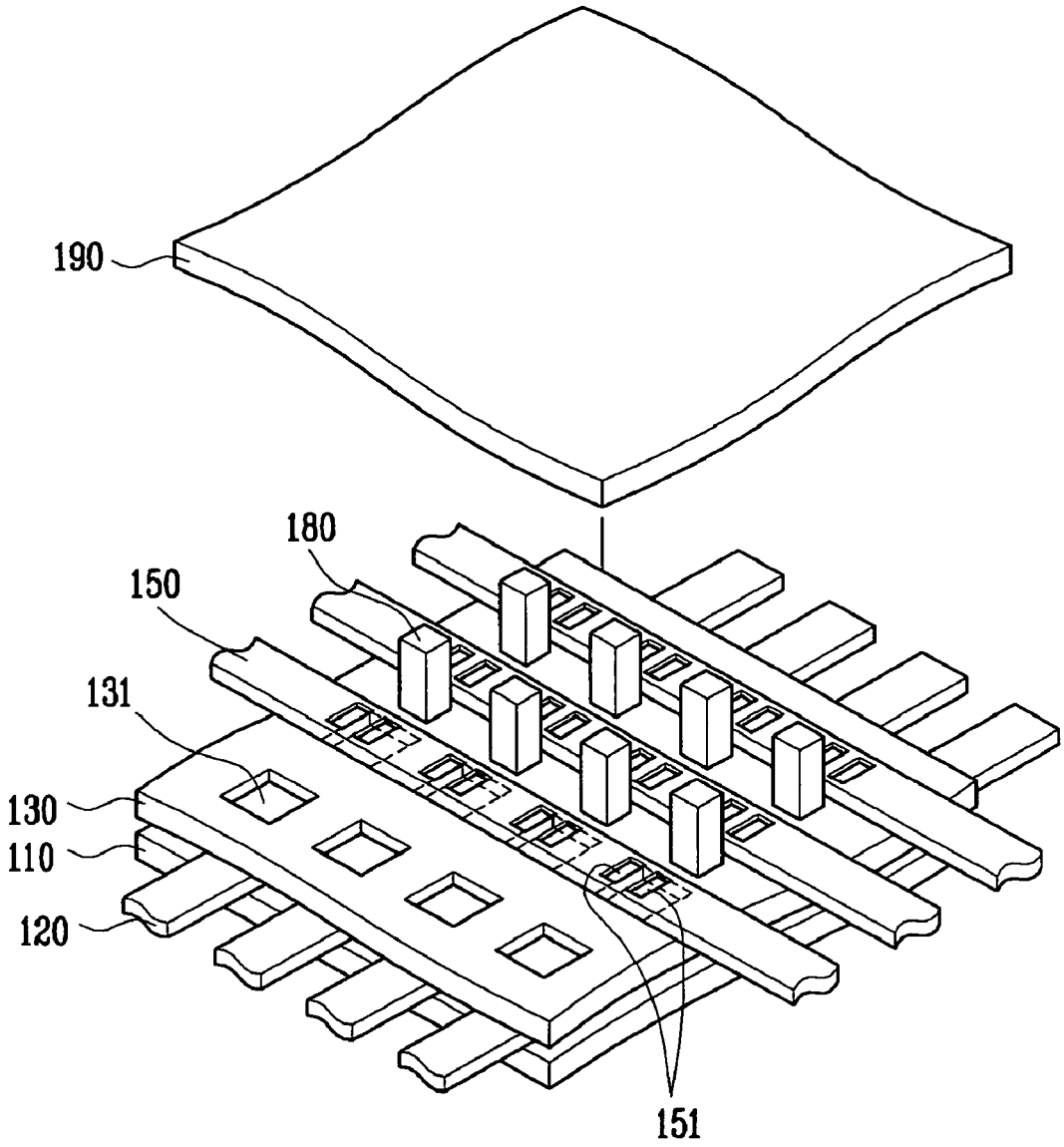
FIG. 5 is a perspective view of an example of a pixel portion of the electron emission display of FIG. 2.
Figure 6:
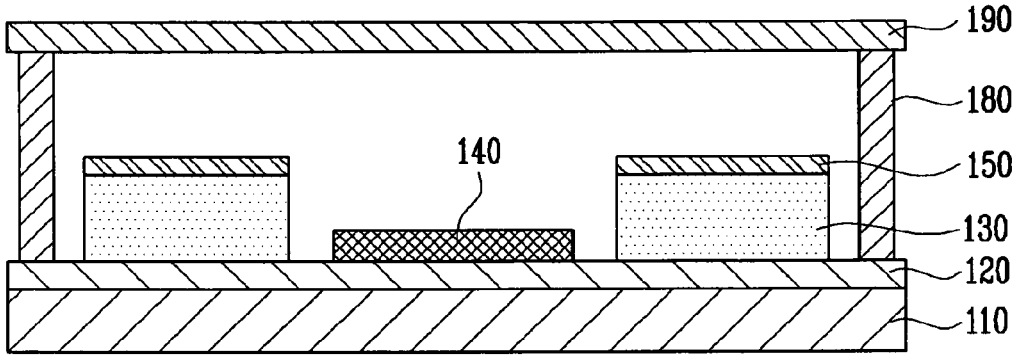
FIG. 6 is a cross-sectional view of the pixel portion of FIG. 5.

FIG. 5 is a perspective view of an example of a pixel portion of the electron emission display shown in FIG. 2, and FIG. 6 is a cross-sectional view of the pixel portion shown in FIG. 5. Referring to FIG. 5 and FIG. 6, the electron emission display includes a lower substrate 110, an upper substrate 190, and a spacer 180. Cathode electrodes 120, an insulation layer 130, an electron emission section 140, gate electrodes 150 are sequentially formed on the lower substrate 110, and a front substrate, an anode electrode, and a fluorescent film are formed on the upper substrate 190.

A least one cathode electrode 120 is formed in a stripe shape on the lower substrate 110, and an insulation layer 130 is formed at an upper portion of the cathode electrode 120. A plurality of first grooves 131 are formed at the insulation layer 130 to expose a part of the cathode electrode 120. At least one gate electrode 150 is formed at an upper portion of the insulation layer 130.

A plurality of second grooves 151 having predetermined sizes are formed at the gate electrode 150, and each of the second grooves 151 is formed at an upper portion of each of the first grooves 131. Furthermore, an electron emission section 140 is disposed at a corresponding area of the first groove 131 and the second groove 151 at the upper portion of the cathode electrode 120.

A glass or silicon substrate is used as the lower substrate 110. When the lower substrate 110 is formed by a rear surface exposure using paste, it is preferred that the lower substrate is a transparent substrate such as a glass substrate.

The cathode electrode 120 provides a data signal from the data driver (not shown) or a scan signal from the scan driver (not shown) to the electron emission section 140. ITO (Indium Tin Oxide) is used as the cathode electrode 120.

The insulation layer 130 is formed at upper portions of the lower substrate 110 and the cathode electrode 120, and electrically insulates the cathode electrode 120 and the gate electrode 150 from each other.

The gate electrode 150 is disposed in a predetermined shape, for example, a stripe shape, on the insulation layer 130 across the cathode electrode 120, and provides the data signal from the data driver 200 or the scan signal from the scan driver 300 to respective pixels. The gate electrode 150 is made of a metal having an excellent conductivity, for example, at least one metal selected from gold (Au), silver (Ag), platinum (Pt), aluminum (Al), chromium (Cr), or an alloy thereof.

The electron emission sections 140 are electrically connected to an upper portion of the cathode electrode 120 exposed by the first opening 131 of the insulation layer 130, respectively. The electron emission section 140 is preferably made of materials that emit electrons upon applying an electric field thereto. Carbon system materials, nanometer (nm) size materials, carbon nanotubes, graphite, graphite nanofibers, carbon on diamond, $C_{60}$, silicon nanofibers, and a combination material thereof are examples of the electron emission material.

Electrons emitted from the electron emission section 140 collide with the upper substrate 190 to emit light, so that an image is formed. The upper substrate 190 includes a substrate, an anode electrode, a fluorescent substance, a light shielding film, and a metal protection film.

The substrate is preferably formed of a transparent material, such as glass, so that light emitted from the fluorescent substance is transferred to an exterior.

The anode electrode is preferably formed of a transparent material, such as an Indium-Tin-Oxide (ITO) electrode, so that light emitted from the fluorescent substance is transferred to an exterior. The anode electrode accelerates electrons emitted from an electron emission element. For this purpose, a positive (+) high voltage is supplied to the anode electrode to cause electrons to be accelerated in a direction of a fluorescent substance.

The fluorescent substance emits light by collisions of electrons emitted from the electron emission section 140, and is selectively disposed on the anode electrode with a predetermined gap therebetween. ZnS:Cu, $Zn_2SiO_4$:Mn, ZnS:Cu+$Zn_2SiO_4$:Mn, $Gd_2O_2S$:Tb, $Y_3Al_5O_{12}$:Ce, ZnS:Cu,Al, $Y_2O_2S$:Tb, ZnO:Zn, ZnS:Cu,Al+$In_2O_3$, $LaPO_4$:Ce,Tb, BaO.6$Al_2O_3$:Mn, (Zn,Cd)S:Ag, (Zn, Cd)S:Cu,Al,ZnS:Cu, Au,Al, $Y_3(Al,Ga)_2O_{12}$:Tb, $Y_2SiO_5$:Tb, or LaOCl:Tb are examples of a G fluorescent substance, that is, a fluorescent substance emitting green light. ZnS:Ag, ZnS:Ag,Al, ZnS:Ag, Ga,Al, ZnS:Ag,Cu,Ga,Cl, ZnS:Ag+$In_2O_3$, $Ca_2B_5O_9Cl:Eu^{2+}$, $(Sr,Ca,Ba,Mg)_{10}(PO_4)_6Cl_2:Eu^{2+}$, $Sr_{10}(PO_4)_6C_2:Eu^{2+}$, $BaMgAl_{16}O_{26}:Eu^{2+}$, CoO, $Al_2O_3$ added ZnS:Ag, ZnS:Ag or Ga can be used as a B fluorescent substance, namely, a fluorescent substance emitting blue light. Furthermore, $Y_2O_2S$:Eu, $Zn_3(PO_4)_2$:Mn, $Y_2O_3$:Eu, $YVO_4$:Eu, (Y, Gd)$BO_3$:Eu, γ-$Zn_3(PO_4)_2$:Mn, (ZnCd)S:Ag, (ZnCd)S:Ag+$In_2O_3$, or $Fe_2O_3$ added $Y_2O_2S$:Eu can be used as an R fluorescent substance, namely, a fluorescent substance emitting red light.

The light shielding film, disposed between fluorescent substances with a gap therebetween, absorbs and shields external light, and prevents optical crosstalk in order to enhance the bright to dark ratio.

The metal protection film is formed on the fluorescent substance, and concentrates the electrons emitted from the electron emission section 140, and reflects light emitted from the fluorescent substance by the collisions of electrons in order to enhance reflection efficiency. On the other hand, if the metal protection film serves as an anode electrode, the formation of the anode electrode is selective, and can be an unnecessary element.

The spacer 180 provides a gap between the lower substrate 110 and the upper substrate 190.

Figure 7:
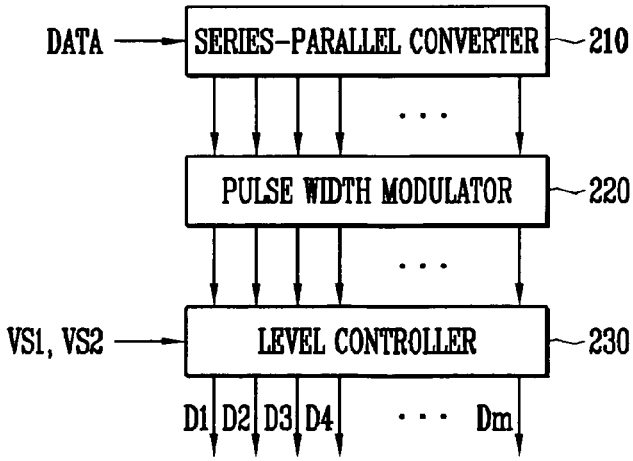
FIG. 7 is a block diagram of an example of a data driver of the electron emission display of FIG. 2.

FIG. 7 is a view of an example of a data driver 200 of the electron emission display of FIG. 2. With reference to FIG. 7, the data driver 200 includes a series-parallel converter 210, a pulse width modulator 220, and a level controller 230.

The series-parallel converter 210 converts and outputs sequentially inputted video data into parallel video data.

The pulse width modulator 220 performs a pulse width modulation of the parallel video data from the series-parallel converter 210 and output a pulse width modulated signal. Consequently, if the parallel video data is data corresponding to a higher gray scale, an output data signal of the pulse width modulator 220 has a wide pulse width. In contrast to this, if the parallel video data is data corresponding a lower gray scale, the output data signal of the pulse width modulator 220 has a narrow pulse width.

The level controller 230 controls a voltage level of the output data signal of the pulse width modulator 220 according to first and second power supply voltages VS1 and VS2 supplied from a power supply section and outputs the output data signal of the pulse width modulator 220 in which the voltage level is controlled, to the data lines D1, D2, . . . Dm. A high level voltage of an output data of the level controller 230 corresponds to the first power supply voltage VS1, whereas a low level voltage thereof corresponds the second power supply voltage VS2. Accordingly, as the first power supply voltage VS1 and/or the second power supply voltage VS2 change, the high level voltage and/or the low level voltage of the data signal are also changed. When the data lines D1, D2, . . . Dm are used as the cathode electrode, when the data signal has a low level voltage, namely, the second power supply voltage VS2, the electron emission element emits the electrons. Accordingly, the power supply section changes the level of the second power supply voltage VS2 that allows a voltage difference between the gate electrode and the cathode electrode during an electron emission to be varied. The level of the first power supply voltage VS1 can be unchanged. Furthermore, the level of the first power supply voltage VS1 can be changed according to a change of the second power supply voltage VS2. In addition, when the data lines D1, D2 . . . Dm are used as the gate electrode, when the data signal has a high level voltage, namely, the first power supply voltage VS1, the electron emission element emits the electrons. Consequently, the power supply section changes the level of the first power supply voltage VS1, thereby causing a voltage difference between the gate electrode and the cathode electrode during the electron emission to be varied. The level of the first power supply voltage VS1 can be unchanged. Furthermore, the level of the second power supply voltage VS2 can be changed according to a change of the first power supply voltage VS1.

If a voltage level controller controls only a voltage level of an output scan signal of the scan driver but does not control a voltage level of an output data signal of the data driver, each level of the first power supply voltage VS1 and the second power supply voltage VS2 can be unchanged. Moreover, the data driver can directly transfer an output data signal of the pulse width modulator 220 to the data lines D1, D2, . . . Dm without including the level controller 230.

Figure 8:
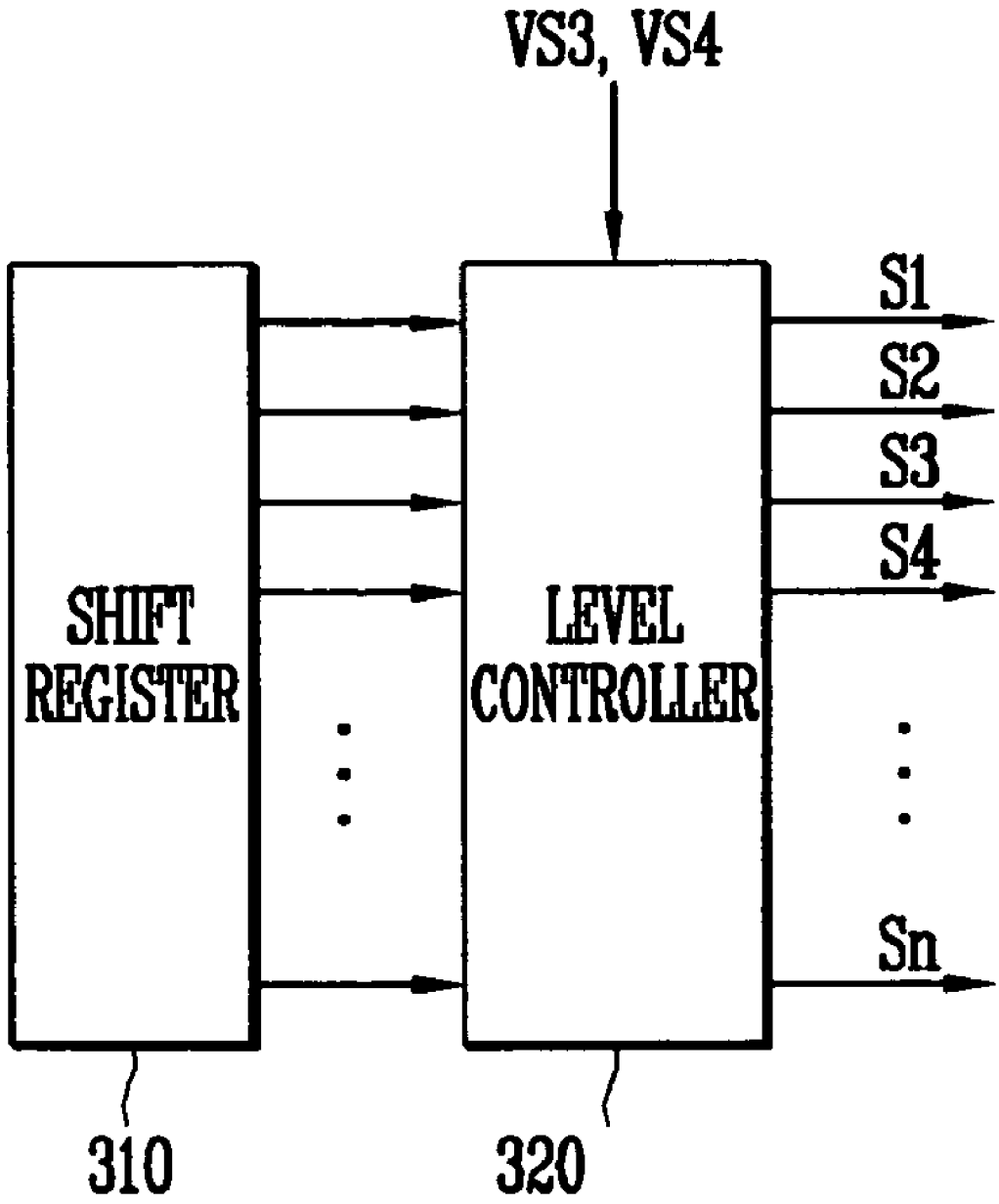
FIG. 8 is a block diagram of an example of a scan driver of the electron emission display of FIG. 2.

FIG. 8 is a view of an example of a scan driver of the electron emission display of FIG. 2. Referring to FIG. 8, the scan driver includes a shift register 310 and a level controller 320.

The shift register 310 performs a function to sequentially output the scan signal.

The level controller 230 controls a voltage level of the scan signal outputted from the shift register 310 according to third and fourth power supply voltage VS3 and VS4 supplied from a power supply section and outputs the scan signal in which the voltage level is controlled, to the scan lines S1, S2, . . . Sn. A high level voltage of an output data of the level controller 230 corresponds to the third power supply voltage VS3, whereas a low level voltage thereof corresponds to the fourth power supply voltage VS4. Accordingly, as the third power supply voltage VS3 and/or the fourth power supply voltage VS4 change, the high level voltage and/or the low level voltage of the data signal is also changed. When the scan lines S1, S2, . . . Sn are used as the cathode electrode, when the scan signal has a low level voltage, namely, the fourth power supply voltage VS4, the electron emission element emits the electrons. Accordingly, the power supply section changes the level of the fourth power supply voltage VS4 that allows a voltage difference between the gate electrode and the cathode electrode during an electron emission to be varied. The level of the third power supply voltage VS3 can be unchanged. Furthermore, the level of the third power supply voltage VS3 can be changed according to a change of the fourth power supply voltage VS4. In addition, when the scan lines S1, S2, . . . Sn are used as the gate electrode, when the scan signal has a high level voltage, namely, the third power supply voltage VS3, the electron emission element emits the electrons. Consequently, the power supply section changes the level of the third power supply voltage VS3, thereby causing a voltage difference between the gate electrode and the cathode electrode during the electron emission to be varied. The level of the first power supply voltage VS3 can be unchanged. Furthermore, the level of the fourth power supply voltage VS4 can be changed according to a change of the third power supply voltage VS3.

If a voltage level controller controls only a voltage level of an output data signal of the data driver but does not control a voltage level of an output scan signal of the scan driver, each level of the third power supply voltage VS3 and the fourth power supply voltage VS4 can be unchanged. Moreover, the scan driver can directly transfer the scan signal from the shift register 310 to the scan lines S1, S2, . . . Sn without including the level controller 230.

In the electron emission display and a driving method thereof, when the electron emission display expresses high gray scale, it limits brightness of each pixel in order to reduce power consumption and prevent a gradual failure from occurring. A change amount by gray scales in low and high brightness are set to be different from each other, so that a user visibly recognizes the change of brightness better.

Although exemplary embodiments of the present invention have been shown and described, it would be appreciated by those skilled in the art that modifications can be made without departing from the principles and spirit of the present invention, the scope of which is defined by the following claims.

What is claimed is:

1. An electron emission display, comprising:

a pixel portion adapted to receive a data signal and a scan signal, and to display an image;

a data driver adapted to generate the data signal using video data and to transfer the data signal to the pixel portion;

a scan driver adapted to transfer the scan signal to the pixel portion;

a timing controller adapted to transfer a drive signal to the data driver and the scan driver, the drive signal adapted to drive the data driver and the scan driver;

a data processor adapted to generate a control signal corresponding to frame data obtained by summing a value of video data inputted during one frame; and a power supply section adapted to generate a drive voltage and to transfer the drive voltage to the pixel portion, the data driver, the scan driver, the timing controller, and the data processor;

wherein a brightness of the pixel portion is changed according to the control signal, an amount of change of the brightness being according to a hysteresis curve, the hysteresis curve comprising a first graph and a second graph, the amount of the change of the brightness being determined in accordance with the first graph when a value of the frame data is increasing, and the amount of the change of the brightness being determined in accordance with the second graph when the value of the frame data is decreasing, wherein the data processor comprises:

a data summer adapted to sum the value of video data inputted during one frame to generate the frame data;

a first look-up table selected when the brightness is increased and adapted to store an output voltage of the power supply section corresponding to the frame data;

a second look-up table selected when the brightness is reduced and adapted to store an output voltage of the power supply section corresponding to the frame data; and a signal processor adapted to detect a value change of the frame data, to select one of the first and second look-up tables according to the value change of the frame data, to generate the control signal corresponding to the output voltage of the power supply section stored in the first or second look-up table, and to control the drive voltage from the power supply section with the control signal.

2. The electron emission display as claimed in claim 1, wherein the hysteresis curve is adapted to maintain a constant brightness when a change of the frame data does not exceed a predetermined value, and to change a brightness when a change of the frame data exceeds the predetermined value.

3. The electron emission display as claimed in claim 1, wherein the first and second look-up tables are adapted to store an output voltage of the power supply section corresponding to different frame data according to a voltage level.

4. The electron emission display as claimed in claim 1, wherein the change amount of the brightness is respectively small and large when the value of the frame data is large and small.

5. The electron emission display as claimed in claim 1, wherein the power supply section is adapted to adjust at least one drive voltage of the pixel portion, the scan driver, and the data driver to adjust one of a voltage supplied to the pixel portion, an output voltage of the scan driver, and an output voltage of the data driver.

6. The electron emission display as claimed in claim 1, wherein the pixel portion comprises:

a lower substrate;

a cathode electrode arranged in a stripe shape on the lower substrate;

a first insulation film arranged on the lower substrate and the cathode electrode and including an opening exposing a portion of the cathode electrode;

a gate electrode arranged on the first insulation film across the cathode electrode, and including a second opening corresponding to the first opening;

an electron emission section arranged on the cathode electrode corresponding to the first and second openings;

a upper substrate spaced apart from the lower substrate and including a fluorescent film adapted to emit light due to electrons emitted by the electron emission section and an anode electrode to which a high voltage is supplied; and a spacer adapted to provide a gap between the lower and upper substrates.

7. The electron emission display as claimed in claim 6, wherein the power supply section is adapted to adjust at least one voltage level of the cathode electrode, the gate electrode, and the anode electrode.

8. A method of driving an electron emission display, the method comprising:

summing a value of video data inputted during one frame to generate frame data;

adjusting a voltage level of a drive power supply corresponding to the value of the frame data; and changing brightness according to the voltage level of the drive power supply, the brightness being changed according to a hysteresis curve, the hysteresis curve comprising a first graph and a second graph, the amount of the change of the brightness being determined in accordance with the first graph when a value of the frame data is increasing, and the amount of the change of the brightness being determined in accordance with the second graph when the value of the frame data is decreasing, wherein the voltage level of the drive power supply is adjusted in accordance with a first look-up table in response to a difference between a value of frame data of a predetermined frame and a value of frame data of a previous frame being positive, and wherein the voltage level of the drive power supply is adjusted in accordance with a second look-up table in response to a difference between a value of frame data of a predetermined frame and a value of frame data of a previous frame being negative.

9. The method as claimed in claim 8, wherein the first and second look-up tables are composed using a predetermined bit of the frame data.

10. The method as claimed in claim 8, wherein the change amount of the brightness is small upon a value of the frame data being large, and wherein the change amount of the brightness is large upon the value of the frame data being small.

11. The method as claimed in claim 8, wherein the voltage level of the drive power supply adjusts at least one of voltage levels of anode, cathode, and gate electrodes of a pixel portion.

* * * * *